United States Patent [19]

Bowcott

[11] 3,958,141

[45] May 18, 1976

[54] FACE COMMUTATOR

[75] Inventor: Roy Price Bowcott, Solihull, England

[73] Assignee: The Lucas Electrical Company Limited, Birmingham, England

[22] Filed: Aug. 28, 1975

[21] Appl. No.: 608,767

[52] U.S. Cl. ..... 310/237

[51] Int. Cl.[2] ..... H01R 39/06

[58] Field of Search ..... 310/231–239

[56] References Cited

UNITED STATES PATENTS

| | | | |
|---|---|---|---|
| 3,538,365 | 11/1970 | Reisnecker | 310/237 |
| 3,568,309 | 3/1971 | Preece | 310/237 |
| 3,705,997 | 12/1972 | Bauerle et al. | 310/237 |
| 3,726,003 | 4/1973 | Hellmann et al. | 310/237 X |
| 3,812,576 | 5/1974 | Yamaguchi | 310/237 X |
| 3,861,027 | 1/1975 | Allen | 310/237 |

*Primary Examiner*—Donovan F. Duggan
*Attorney, Agent, or Firm*—Olson, Trexler, Wolters, Bushnell & Fosse, Ltd.

[57] ABSTRACT

A face commutator for a dynamo electric machine comprises a body carrying a plurality of conductive segments. The segments are arranged in a circle with each segment extending radially. The rear face of each segment includes a channel the radially outermost wall of which is defined by a pair of rearwardly extending circumferentially divergent integral projections which key the outer end of the segment into the body. The other wall of the channel of each segment is defined by a rearwardly extending lug adjacent the radially inner end of the segment, the face of the lug presented to the pair of projections being undercut and so providing keying to the body at the radially innermost end of the segment.

1 Claim, 11 Drawing Figures

FACE COMMUTATOR

This invention relates to a face commutator for a dynamo electric machine, and is divided from my co-pending U.S. patent application Ser. No. 539,340.

A face commutator according to the invention comprises a moulded synthetic resin body arranged to be secured to a dynamo electric machine rotor shaft for rotation therewith, the body carrying a plurality of conductive segments disposed on the body in a circle having its centre on the rotational axis of the body, said segments extending radially with respect to said axis with front faces thereof generally co-planar and rear faces thereof presented to the body, each segment being keyed into the moulded body at both the radially inner and radially outer ends of its rear face and each segment having in its rear face a channel the radially outermost wall of which is defined by a pair of rearwardly extending, circumferentially divergent, integral projections which key the radially outer end of the segment into the moulded body, and the other wall of said channel being defined by a rearwardly extending lug adjacent the radially inner end of the segment, the face of said lug presented to said pair of projections being under-cut and so providing keying between the segment and the body at the radially inner end of the segment.

Figure 1:
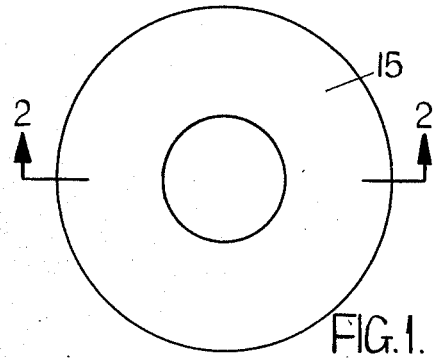
Figure 3:
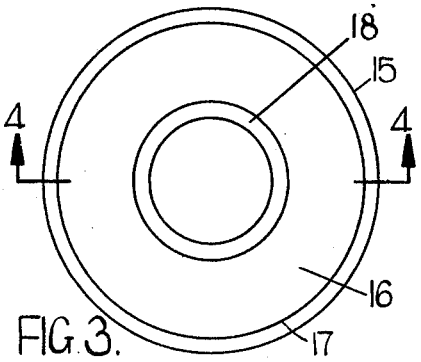
Figure 2:
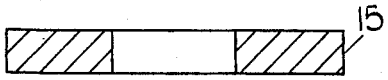
Figure 4:
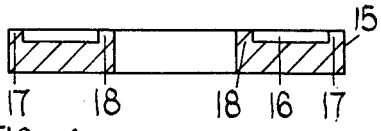
Figure 5:
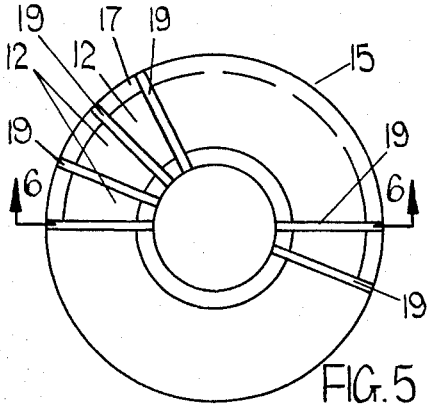
Figure 7:
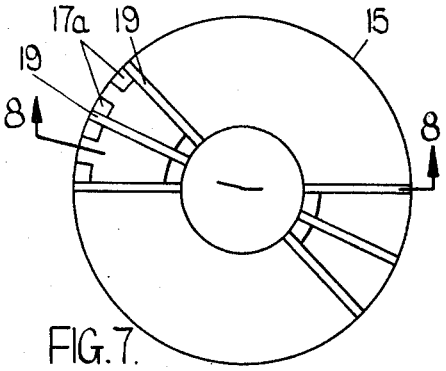
Figure 6:
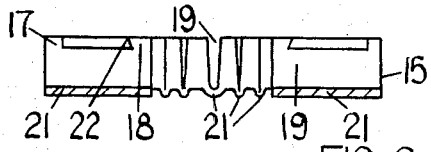
Figure 8:
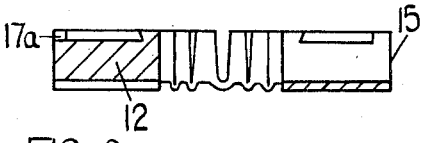
Figure 10:
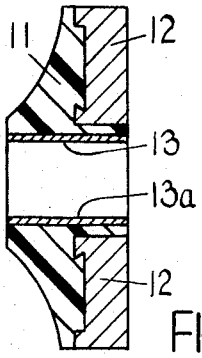
Figure 9:
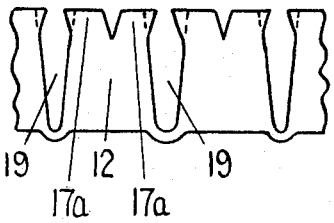
Figure 11:
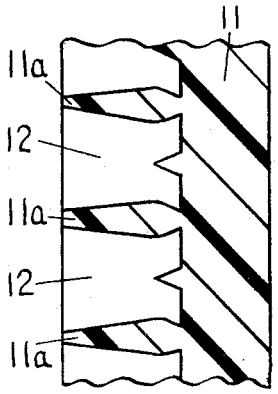

One example of the invention is illustrated in the accompanying drawings wherein, FIGS. 1, 3, 5 and 7 are plan views respectively of a face commutator at various stages in its manufacture, FIGS. 2, 4, 6 and 8 are sectional views on the appropriately marked lines in FIGS. 1, 3, 5 and 7 respectively, FIG. 9 is a fragmentary side elevational view of the component shown in FIG. 8, but to an enlarged scale, FIG. 10 is a simplified sectional view of the commutator, and FIG. 11 is an enlarged view similar to FIG. 9 showing part of the commutator body in section.

Referring to the drawings, the face commutator includes a moulded synthetic resin body 11 (FIG. 10) carrying a plurality of copper segments 12 on one face thereof. The body has therein a bore 13 containing a liner 13*a* whereby the commutator can be mounted on the rotor shaft of a dynamo electric machine for rotation with the shaft, and the segments 12 are disposed in a circle about the axis of the bore 13. The segments 12 are generally equi-angularly spaced, and are insulated from one another by projecting portions 11*a* of the body 11. The surfaces of the segments 12 remote from the body are generally co-planar, and constitute the brush engaging surface of the commutator.

The commutator is manufactured in the following manner.

An annular copper blank 15 is stamped from a sheet of copper, and is subjected on one face thereof to a stamping operation to produce in said one face an annular channel 16. The side walls of the channel 16 define outer and inner parallel, peripheral flanges 17, 18. Said one face is then subject to a second stamping operation using a tool of V-shaped cross-section to produce in said one face a plurality of equi-angularly spaced radially extending grooves 19 of V-shaped cross-section. The tool used to form the grooves is sufficiently wide that the grooves extend over the whole radial width of the blank. A further stamping tool also of V-shaped cross-section, but of smaller apical angle than the preceding tool is used to extend the depth of the grooves 19 such that the grooves 19 are depper than the thickness of the blank 15, and corresponding ribs 21 are produced on the opposite face of the blank. It will be appreciated that if a suitable tool is available then the two stages in the formation of the grooves 19 can be performed in a single operation. The formation of the grooves 19 and ribs 21 divides the blank 15 into a plurality of segments 12 each connected to its neighbour by the material of the appropriate rib 21. Additionally, the stamping operation to produce the grooves 19 deforms the inner peripheral flange 18 such that its inner surface 22 is undercut. This can be best seen in FIG. 6, where the inclination of the surface 22 has been exaggerated.

The blank 15, after the formation of the grooves 19 and ribs 21, is then indexed through half the angle subtended by adjacent grooves 19 and a further stamping operation is performed on each segment 12. The further stamping operation bifurcates the portion of the flange 17 of each segment to define a pair of projections 17*a*. The stamping operation further serves to deform the projections 17*a* away from one another so that each segment includes at its outer periphery a pair of integral, and divergent projections 17*a*. FIG. 9 shows the divergent projections 17*a*, and additionally in dotted lines shows the form of the portions of the flange 17 of each segment prior to the bifurcating operation.

The blank is next mounted in a mould, and synthetic resin is injected into the mould to form the commutator body 11. Said one face of the blank is presented to the synthetic resin, and the molten synthetic resin flows into the channel 16, and the grooves 19. Owing to the divergent nature of the projections 17*a* of each segment then the grooves 19 adjacent the outer periphery of the blank are of a re-entrant nature. Thus when the synthetic resin material sets each segment 12 is keyed, at its outer periphery, to the body 11 by the divergent projections 17*a*. Similarly, the molten synthetic resin material flows under the undercut surface 22 adjacent the inner periphery of each segment, and when the synthetic resin material sets each segment is keyed to the body 11 adjacent its inner periphery. The blank together with its body are then milled to produce in each segment a radially extending slot for receiving connecting wires. When the body is moulded, the axial bore thereof is provided with a liner for receiving the rotor shaft of the dynamo electric machine utilizing the commutator. The body of the commutator extends between the liner and the inner peripheries of the segments to ensure that the segments are not electrically interconnected by the liner. After formation of the slots the body is mounted on the rotor shaft and the electrical connector between the segments and the armature of the rotor assembly are made. Finally, the face of the commutator remote from the body 11 is machined to remove the rib 21 thereby physically and electrically separating the segments from one another. Additionally, the machining operation renders the brush receiving faces of the segments coplanar and at right angles to the rotor shaft axis. Each segment is of course individually strongly keyed to the body 11 at its outer periphery by the divergent projections 17*a*, and adjacent its inner periphery by the under cut surface 22.

I claim:

1. A face commutator comprising a moulded synthetic resin body arranged to be secured to a dynamo electric machine rotor shaft for rotation therewith, the body carrying a plurality of conductive segments disposed on the body in a circle having its centre on the rotational axis of the body, said segments extending radially with respect to said axis with front faces thereof generally co-planar and rear faces thereof presented to the body, each segment being keyed into the moulded body at both the radially inner and radially outer ends of its rear face and each segment having in its rear face a channel the radially outermost wall of which is defined by a pair of rearwardly extending, circumferentially divergent, integral projections which key the radially outer end of the segment into the moulded body, and the other wall of said channel being defined by a rearwardly extending lug adjacent the radially inner end of the segment, the face of said lug presented to said pair of projections being under-cut and so providing keying between the segment and the body at the radially inner end of the segment.

* * * * *